US010726728B2

(12) United States Patent
Kubo et al.

(10) Patent No.: US 10,726,728 B2
(45) Date of Patent: Jul. 28, 2020

(54) SYSTEM AND METHOD FOR CONTROLLING MOVABLE BODY

(71) Applicant: HITACHI, LTD., Tokyo (JP)

(72) Inventors: Hiroyuki Kubo, Tokyo (JP); Shoji Yunoki, Tokyo (JP)

(73) Assignee: HITACHI, LTD., Tokyo (JP)

( * ) Notice: Subject to any disclaimer, the term of this patent is extended or adjusted under 35 U.S.C. 154(b) by 0 days.

(21) Appl. No.: 16/270,182

(22) Filed: Feb. 7, 2019

(65) Prior Publication Data

US 2019/0259285 A1 Aug. 22, 2019

(30) Foreign Application Priority Data

Feb. 22, 2018 (JP) ..... 2018-030184

(51) Int. Cl.

| | |
|---|---|
| ***G08G 1/16*** | (2006.01) |
| ***G08G 1/01*** | (2006.01) |
| ***G08G 1/09*** | (2006.01) |
| ***G08G 1/0965*** | (2006.01) |
| ***G08G 1/0967*** | (2006.01) |

(52) U.S. Cl.

CPC ..... *G08G 1/167* (2013.01); *G08G 1/0133* (2013.01); *G08G 1/0145* (2013.01); *G08G 1/093* (2013.01); *G08G 1/0965* (2013.01); *G08G 1/096791* (2013.01); *G08G 1/162* (2013.01); *G08G 1/166* (2013.01)

(58) Field of Classification Search

CPC ..... G08G 1/167; G08G 1/096791; G08G 1/0133; G08G 1/0145; G08G 1/093; G08G 1/0965; G08G 1/162; G08G 1/166

See application file for complete search history.

(56) References Cited

U.S. PATENT DOCUMENTS

| | | | | |
|---|---|---|---|---|
| 2008/0161986 | A1 | 7/2008 | Breed | |
| 2009/0160678 | A1* | 6/2009 | Turnbull | B60Q 1/525 340/944 |
| 2010/0315217 | A1 | 12/2010 | Miura et al. | |
| 2017/0337816 | A1* | 11/2017 | Lu | G08G 1/166 |
| 2018/0105186 | A1 | 4/2018 | Motomura et al. | |

FOREIGN PATENT DOCUMENTS

| | | | |
|---|---|---|---|
| EP | 3272611 | A1 | 1/2018 |
| JP | 2006-293615 | A | 10/2006 |
| JP | 2010-287162 | A | 12/2010 |
| WO | 92/21116 | A1 | 11/1992 |

OTHER PUBLICATIONS

Extended European Search Report dated Jul. 15, 2019 for the European Patent Application No. 19157702.2.

* cited by examiner

*Primary Examiner* — Rodney A Butler
(74) *Attorney, Agent, or Firm* — Volpe and Koenig, P.C.

(57) ABSTRACT

Disclosed is a control system mounted on a first movable body. The control system has a sensor recognizing a peripheral object of the first movable body, a processor connected to the sensor, and an output device connected to the processor. The processor estimates safety of overtaking of the first movable body by a second movable body moving at the back of the first movable body, on the basis of information acquired from the sensor, and the processor outputs an estimation result of the safety to the second movable body via the output device.

10 Claims, 11 Drawing Sheets

SYSTEM AND METHOD FOR CONTROLLING MOVABLE BODY

CLAIM OF PRIORITY

The present application claims priority from Japanese patent application JP 2018-030184 filed on Feb. 22, 2018, the content of which is hereby incorporated by reference into this application.

BACKGROUND OF THE INVENTION

1. Field of the Invention

The present invention relates to technology for realizing safe overtaking of a movable body.

2. Description of the Related Art

A traveling speed of each movable body traveling on a road or the like is different. Therefore, when a traveling speed of a following movable body is higher than a traveling speed of a preceding movable body in the same lane, the following movable body may perform overtaking for passing through sideways of the preceding movable body and moving in front of the preceding movable body.

An autonomously traveling movable body such as an automatic operation vehicle is designed with emphasis on safety of traveling in an early stage of introduction to a market in particular and travels at a traveling speed lower than a traveling speed of a skilled driver. For this reason, it is considered that a vehicle operated by a person often overtakes the autonomously traveling movable body. Generally, since overtaking is an act of requiring a change of a lane or a protrusion to an opposite lane and increasing an accident potential, in an environment where overtaking frequently occurs, a method for safely performing overtaking is required.

As this type of conventional technology, there are JP 2010-287162 A and JP 2006-293615 A. JP 2010-287162 A (operation support device) discloses a method for evaluating safety in an operation when an own vehicle overtakes a preceding vehicle.

In addition, JP 2006-293615 A (vehicle overtaking support device) discloses a method for enabling an exchange of information on overtaking between a preceding vehicle and a following vehicle.

SUMMARY OF THE INVENTION

A danger potential in an overtaking operation is that a view of a following movable body performing overtaking is blocked by a preceding movable body, so that a situation after the following movable body performs the overtaking operation cannot be sufficiently predicted. Therefore, if information for determining the situation after the overtaking operation grasped by the preceding movable body can be provided to the following movable body, the danger potential of the overtaking operation can be decreased.

In order to widely provide a method for supporting safe overtaking, first, it is required to provide appropriate information to the following movable body at all times according to road situations, such as suppressing the overtaking operation of the following movable body in a road situation not suitable for overtaking and recommending the overtaking operation by transmitting a road situation suitable for overtaking in the road situation suitable for the overtaking.

Second, it is required to transmit information from the preceding movable body to the following movable body using an information transmission mechanism to be widely used, instead of information transmission using a specific device provided in a specific movable body.

In the method disclosed in JP 2010-287162 A, a method for sequentially calculating the safety of its operation by the following movable body performing the overtaking operation and interrupting the overtaking operation when the safety is impaired is disclosed. Although this method can interrupt a dangerous overtaking operation, the method cannot provide information to increase the safety of the overtaking operation.

In the method disclosed in JP 2006-293615 A, a method for sharing information on the overtaking operation via an inter-vehicle communication device provided in each of the preceding and following movable bodies is disclosed. However, in this method, information cannot be provided to a movable body not provided with the inter-vehicle communication device and its application range is limited. In addition, the information transmitted from the preceding vehicle to the following vehicle is limited to an expression of the intention of performing overtaking and it is impossible to suppress the dangerous situation by overtaking.

In order to solve the above problem, the present invention adopts the following configuration. That is, an aspect of the present invention provides a control system mounted on a first movable body. The control system has a sensor recognizing a peripheral object of the first movable body, a processor connected to the sensor, and a first output device connected to the processor. The processor estimates safety of overtaking of the first movable body by a second movable body moving at the back of the first movable body, on the basis of information acquired from the sensor, and the processor outputs an estimation result of the safety to the second movable body via the first output device.

According to an aspect of the present invention, when another movable body moves at the back of a movable body, it is possible to prevent dangerous overtaking from being performed by the following movable body.

Other objects, configurations, and effects of the invention will become apparent from the following description of embodiments.

DESCRIPTION OF THE PREFERRED EMBODIMENTS

First Embodiment

Figure 1:
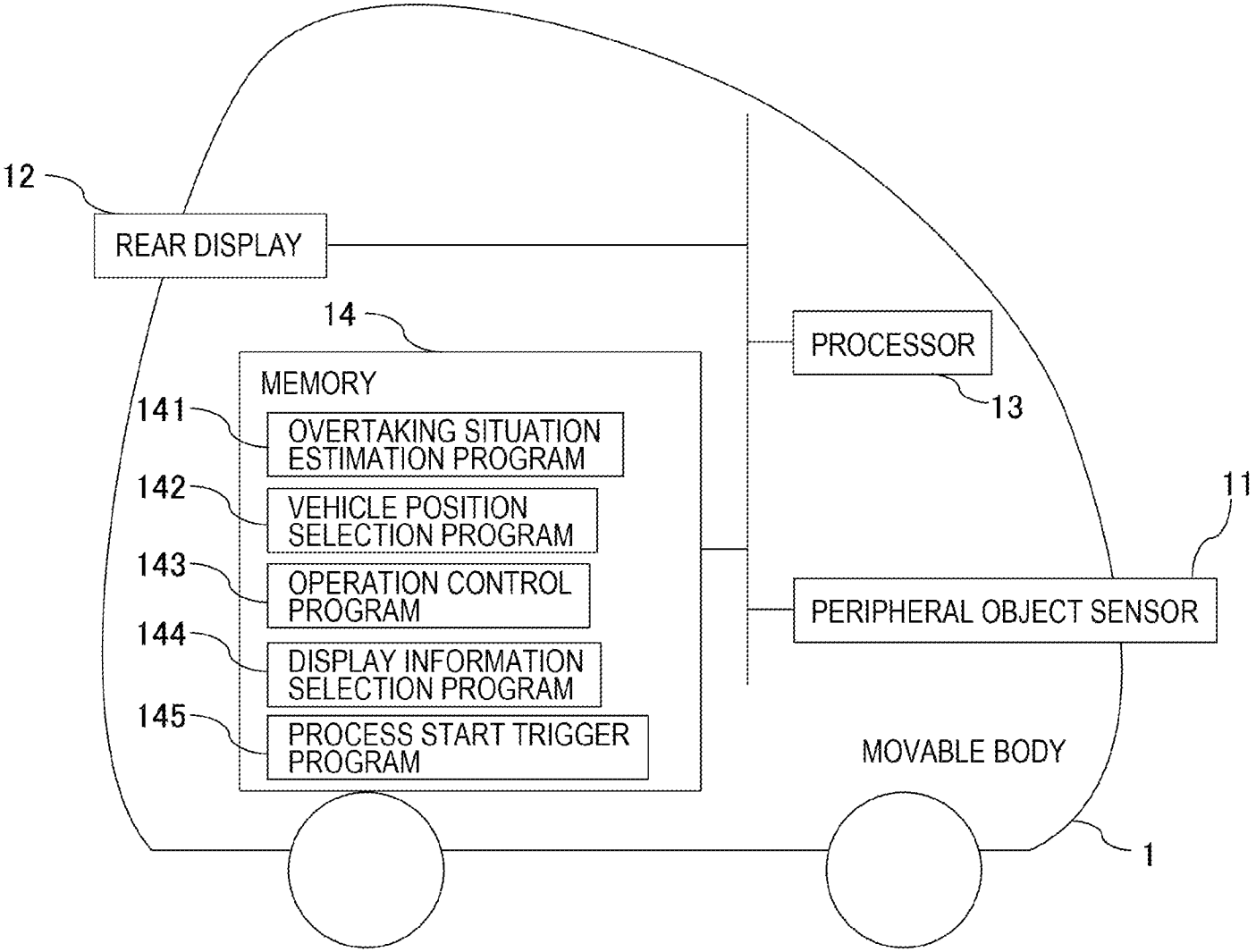
FIG. 1 is a block diagram showing a configuration of a movable body in a first embodiment of the present invention.

FIG. 1 is a block diagram showing a configuration of a movable body 1 in a first embodiment of the present invention.

The movable body 1 includes a control system including a peripheral object sensor 11, a rear display 12, a processor 13, and a memory 14 for holding a plurality of programs. The movable body 1 has an autonomous traveling function and includes components necessary for autonomous traveling.

The peripheral object sensor 11 refers to sensors for recognizing objects around the movable body 1, such as an in-vehicle camera, a radar and a rider (light detection and ranging or laser imaging detection and ranging), and the like and includes any single body of these sensors or a sensor group including a plurality of sensors.

The rear display 12 is a display device for displaying information such as characters or images with respect to a vehicle traveling at the back of the movable body 1. The rear display 12 can change information to be displayed according to an instruction from a program in the connected memory. Further, the rear display 12 may have a function of changing a direction and an angle of the display by a physical mechanism (for example, a drive device such as a motor not shown in the drawings), according to an instruction from a program in the connected memory. Further, the rear display 12 may have a function of changing setting relating to visibility such as a brightness, according to an instruction from a program in the connected memory.

An overtaking situation estimation program 141 is a program for causing the processor 13 to execute a process of estimating safety when a following movable body overtakes the movable body 1, on the basis of information of peripheral objects recognized by the peripheral object sensor 11.

A vehicle position selection program 142 is a program for causing the processor 13 to execute a process of determining a traveling position of the movable body 1 in a lane, on the basis of an overtaking situation estimated by the overtaking situation estimation program 141.

An operation control program 143 is a program for causing the processor 13 to execute vehicle control for changing the traveling position of the movable body 1 to the traveling position in the lane determined by the vehicle position selection program 142.

A display information selection program 144 is a program for causing the processor 13 to execute a process of determining information to be displayed on the rear display 12 and rendering the information on the rear display 12, on the basis of an overtaking situation estimated by the overtaking situation estimation program 141. Further, in the case where the rear display 12 has a function of changing settings relating to a direction, an angle, and visibility, the display information selection program 144 may cause the processor 13 to execute a process of changing the setting, according to external information such as a position of the following movable body recognized by the peripheral object sensor 11.

A process start trigger program 145 is a program for causing the processor 13 to execute a process of monitoring a distance between the following movable body and the movable body 1 recognized by the peripheral object sensor 11 and determining whether the distance becomes a predetermined threshold value or less.

As described above, various functions are realized by executing each program by the processor 13. In the following description, the process executed by each program is actually executed by the processor 13 according to commands included in each program.

Figure 2:
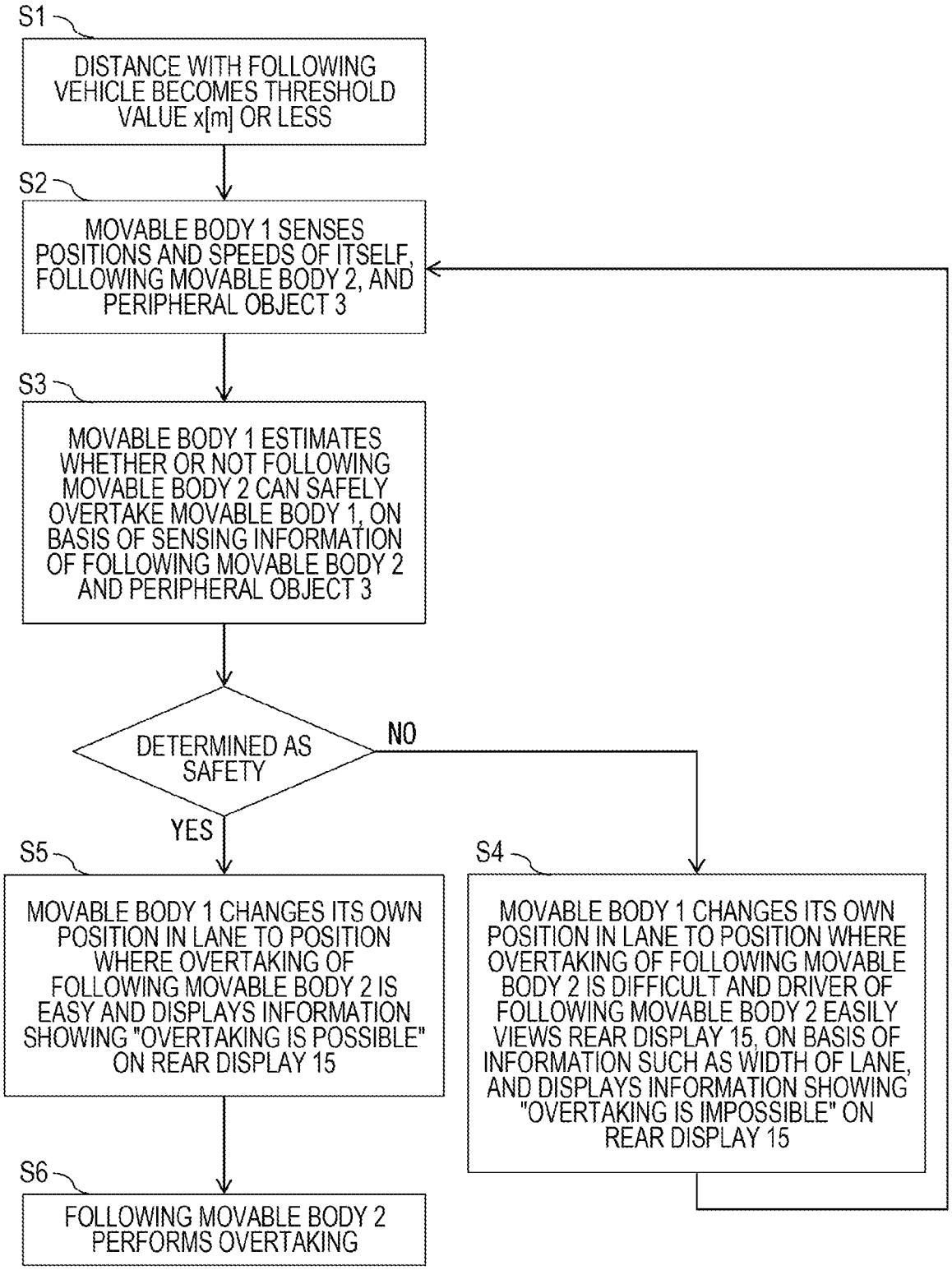
FIG. 2 is a flowchart showing a whole process of the movable body in the first embodiment of the present invention.

FIG. 2 is a flowchart showing a whole process of the movable body 1 in the first embodiment of the present invention. Hereinafter, an operation of the present embodiment will be described according to the present flowchart.

The process start trigger program always uses the peripheral object sensor 11 to detect existence of the following movable body traveling in the same direction as itself (that is, the movable body 1 on which the processor 13 executing the program is mounted) and measure a distance between the movable body and itself. When the distance with the following movable body becomes the predetermined threshold value x[m] or less, the subsequent process is started (S1).

The overtaking situation estimation program 141 uses the peripheral object sensor 11 to sense information such as positions of itself, the following movable body where the distance with itself becomes the threshold value x[m] or less, and the peripheral object and traveling speeds of both the movable bodies (S2).

Figure 3:
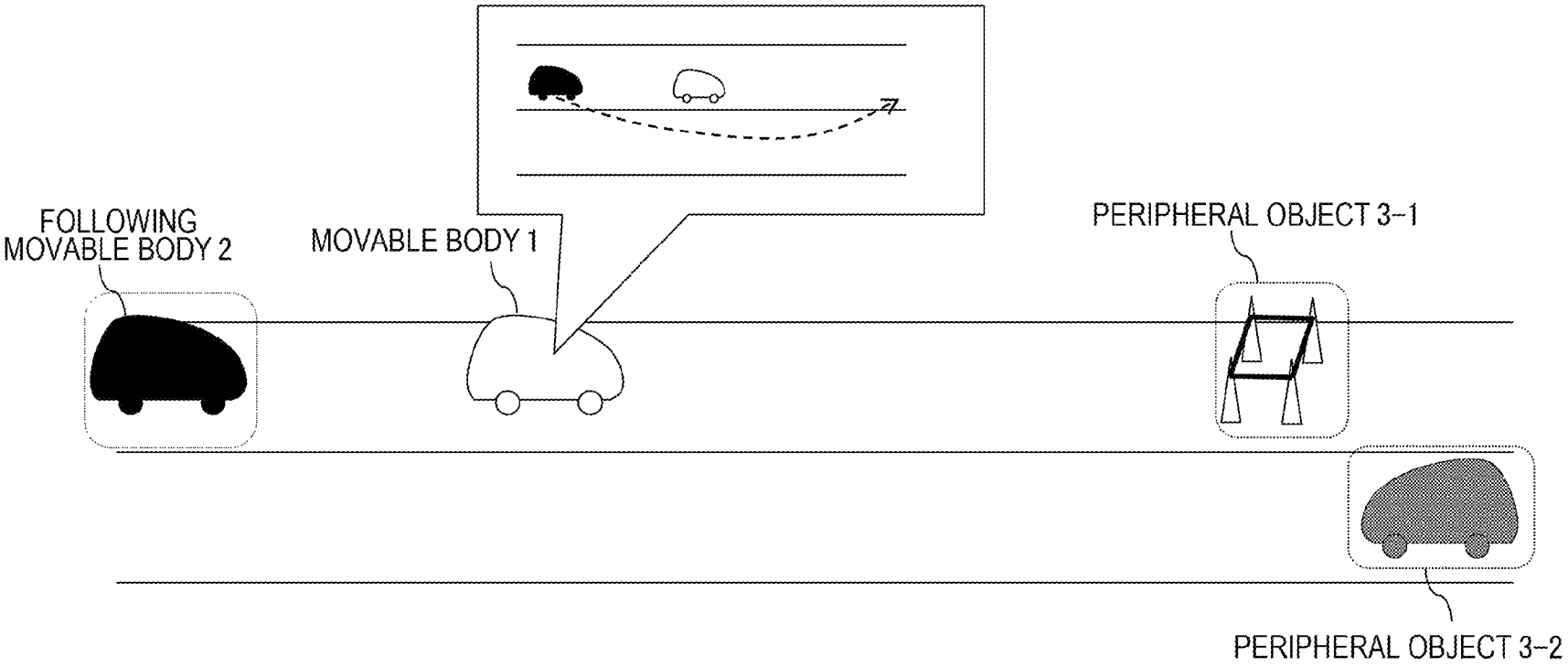
FIG. 3 is a schematic diagram showing an example of a situation where the movable body performs an overtaking situation estimation in the first embodiment of the present invention.

FIG. 3 is a schematic diagram showing an example of a situation where the movable body 1 performs an overtaking situation estimation in the first embodiment of the present invention.

In this situation, driving over a centerline for overtaking is allowed on a single-lane road. The following movable body 2 moves at a higher speed than the movable body 1 and the distance with the movable body 1 gradually decreases and becomes the threshold value x[m] or less. In front of the movable body 1, there are peripheral objects 3-1 (construction) and 3-2 (movable body traveling in an opposite lane) that can affect overtaking by the following movable body 2.

The overtaking situation estimation program 141 estimates whether or not the following movable body 2 can safely overtake itself (for example, whether or not the safety of overtaking is higher than a predetermined standard), on the basis of the information sensed in S2 (S3). An estimation mechanism uses a method examined for an autonomously traveling movable body, such as a method described in JP 2016-11030 A, for example. Known technologies including the method described in the above document are generally mechanisms for verifying the safety when an autonomously traveling movable body overtakes a preceding movable body. However, if the distance between the movable body 1 and the following movable body 2, the road situation, and the peripheral object information can be sensed correctly, according to applications of the above known technologies, as in the present embodiment, when the movable body 1 is overtaken by the following movable body 2, it is possible to estimate whether or not overtaking can be performed safely. At this time, if the movable body 1 has information of the peripheral road and the like for autonomous traveling, an overtaking situation can be estimated using the information.

Figure 4:
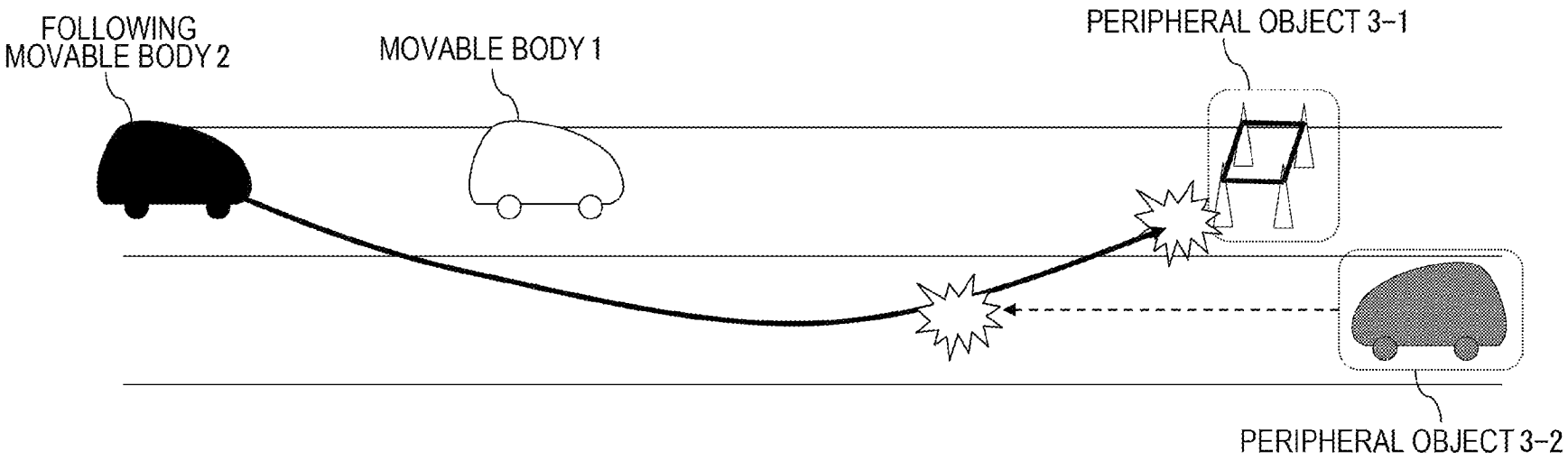
FIG. 4 is an explanatory diagram showing an example of a situation where it is determined that a following movable body cannot safely overtake the movable body in the first embodiment of the present invention.

FIG. 4 is an explanatory diagram showing an example of a situation where it is determined that the following movable body cannot safely overtake the movable body 1 in the first embodiment of the present invention.

As shown in FIG. 4, when the peripheral objects 3-1 and 3-2 exist in the vicinity of the front, the overtaking situation estimation program 141 determines that the following movable body 2 cannot safely overtake the movable body 1.

Figure 5:
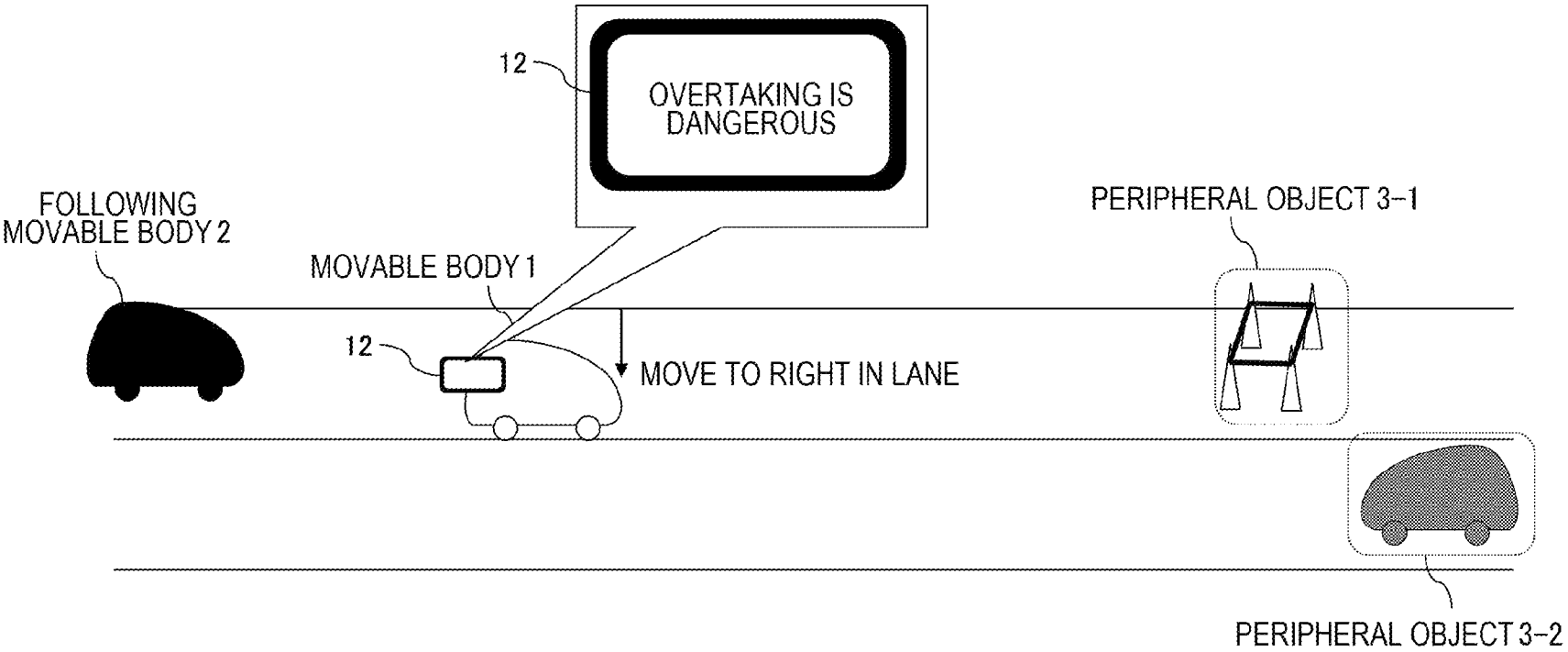
FIG. 5 is an explanatory diagram showing an example of an operation performed by the movable body when it is determined that the following movable body cannot safely overtake the movable body in the first embodiment of the present invention.

FIG. 5 is an explanatory diagram showing an example of an operation performed by the movable body 1 when it is determined that the following movable body 2 cannot safely overtake the movable body 1 in the first embodiment of the present invention.

Because the movable body 1 exists at the front, the peripheral objects 3-1 and 3-2 may be difficult to view from the following movable body 2. Therefore, the movable body 1 performs an operation for notifying the following movable body 2 that it is dangerous to perform overtaking at present. The vehicle position selection program 142 selects a position where the following movable body 2 is hard to overtake the movable body 1 as its own position in the lane.

At this time, the vehicle position selection program 142 may specify a position relation between the movable body 1 and the following movable body 2 on the basis of the information acquired from the peripheral object sensor 11 and may select a position where the following movable body 2 is hard to overtake the movable body 1 and a driver of the following movable body 2 easily views the rear display 12 as its own position in the lane, on the basis of the specified position relation. Alternatively, the vehicle position selection program 142 may specify a direction of a screen of the rear display 12 which the driver of the following movable body 2 easily views, on the basis of the specified position relation, and may control a drive device of the rear display 12 so as to be oriented in the direction.

For example, the vehicle position selection program 142 may select a position closer to the opposite lane than the center of the lane. In the present embodiment, since a road for left-side traveling is assumed, the position closer to the opposite lane than the center of the lane means a rightward position in the lane. In the following description, the rightward position in the lane means the position closer to the opposite lane than the center of the lane and a leftward position in the lane means a position farther from the opposite lane than the center of the lane. In the case where the present invention is applied to the road for right-side traveling, the leftward position in the lane becomes the position closer to the opposite lane than the center of the lane and the rightward position in the lane becomes the position farther from the opposite lane than the center of the lane.

The operation control program 143 performs control for moving the movable body 1 to the position in the lane. Specifically, the processor 13 outputs a signal for controlling a steering device (not shown in the drawings) and a drive device (not shown in the drawings) of the movable body 1 and performs control so that the movable body 1 travels at the rightward position in the lane according to the control signal. Further, the display information selection program 144 displays information showing that overtaking is impossible as an estimation result of the safety of overtaking on the rear display 12 (S4). FIG. 5 shows an example of the operation in S4.

FIG. 7 is an explanatory diagram showing another example of information output by the movable body 1 when it is determined that the following movable body 2 cannot safely overtake the movable body 1 in the first embodiment of the present invention.

Figure 7A:
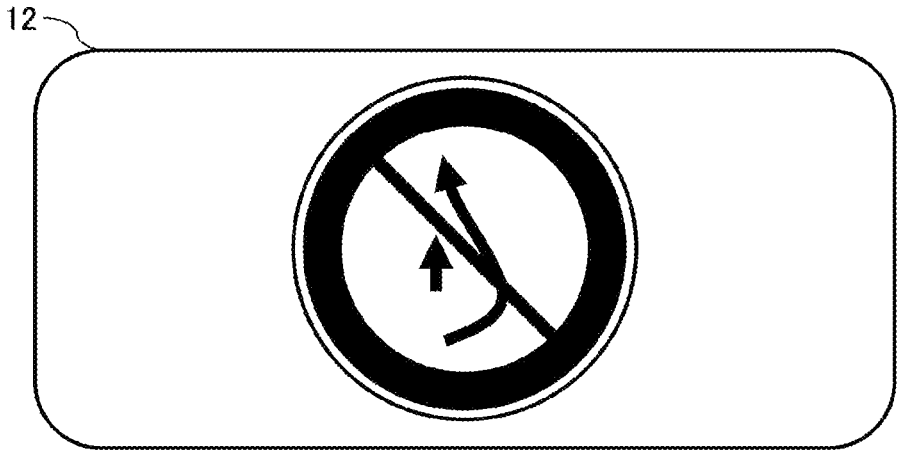
FIGS. 7A and 7B are explanatory diagrams showing another example of information output by the movable body when it is determined that the following movable body cannot safely overtake the movable body in the first embodiment of the present invention.
Figure 7B:
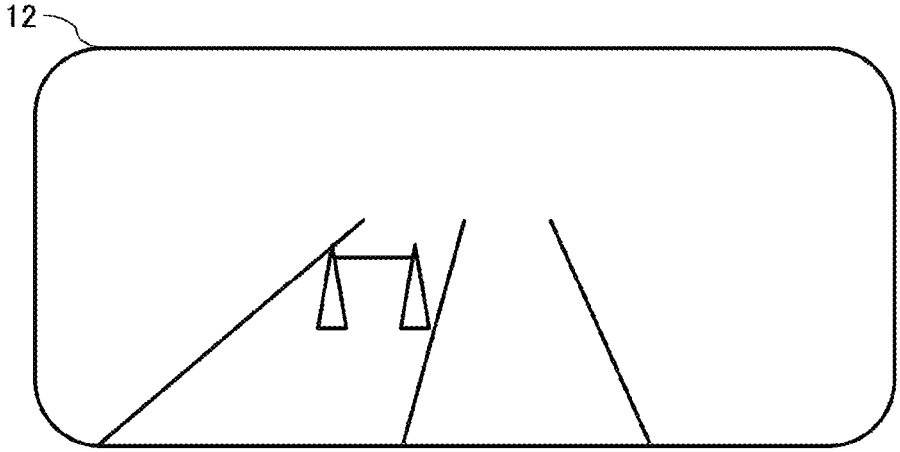

The information displayed by the rear display 12 of the movable body 1 may be, for example, characters such as "overtaking is impossible" shown in FIG. 5 or an image of an icon showing "overtaking is impossible" as shown in FIG. 7A. Alternatively, when the movable body 1 includes an in-vehicle camera or the like for photographing the front of the movable body 1 as the peripheral object sensor 11, the rear display 12 may display front video photographed by the in-vehicle camera as shown in FIG. 7B. Alternatively, the rear display 12 may display a combination thereof.

The rear display 12 in the above example is an example of a device for outputting an estimation result of the safety of overtaking and notifying the following movable body 2 of information is not limited to being performed by displaying information on the rear display 12. In the case where the movable body 1 includes an audio output device such as a speaker instead of the rear display 12, audio information may be used to transmit information showing that the overtaking is dangerous to the following movable body 2. Further, when the movable body 1 includes both the rear display 12 and the speaker, the video information and the audio information may be combined and output.

The overtaking situation estimation program 141 returns to S2 after S4 and repeatedly performs the estimation until overtaking can be performed safely.

Figure 6:
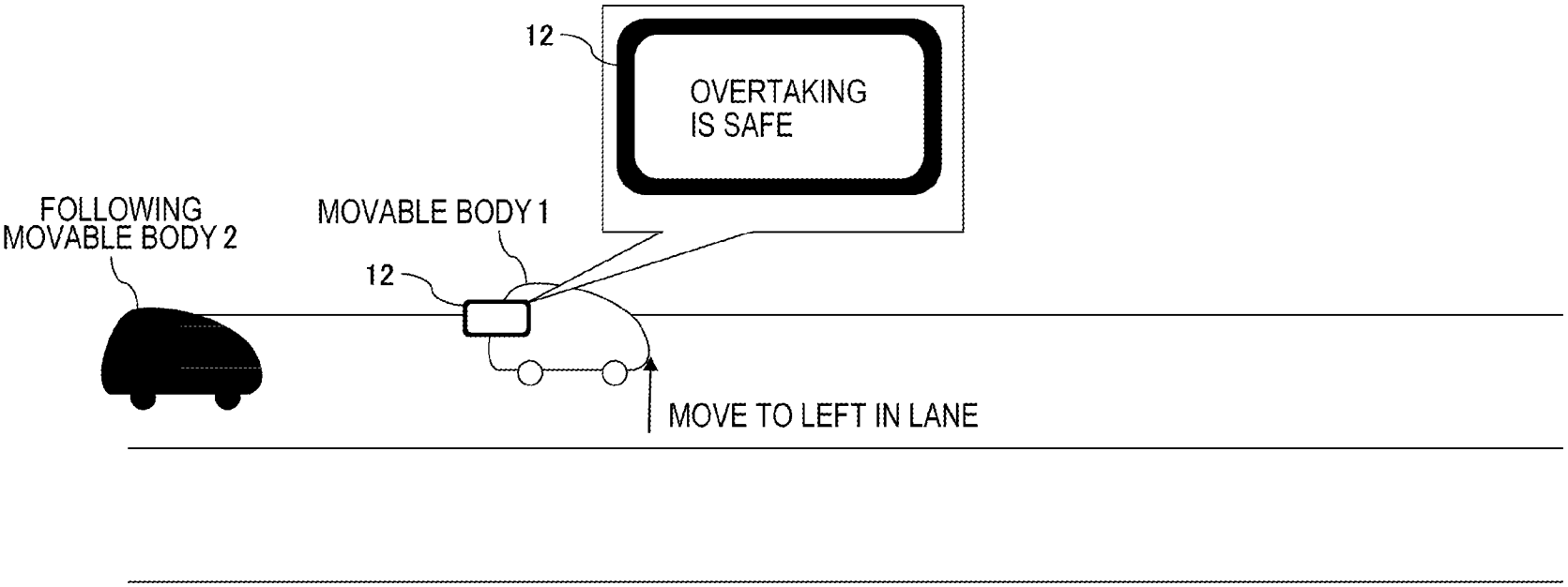
FIG. 6 is an explanatory diagram showing an example of a situation where it is determined that the following movable body can safely overtake the movable body and an operation performed by the movable body in this situation, in the first embodiment of the present invention.

FIG. 6 is an explanatory diagram showing an example of a situation where it is determined that the following movable body can safely overtake the movable body 1 and an operation performed by the movable body 1 in this situation, in the first embodiment of the present invention.

As shown in FIG. 6, when the peripheral object does not exist within a range of a front constant distance, the overtaking situation estimation program 141 estimates that overtaking can be performed safely.

The vehicle position selection program 142 selects a position where the following movable body 2 easily overtakes the movable body 1, such as the left side in the lane, as its own position in the lane. The operation control program 143 performs control for moving the movable body 1 to the position in the lane. Further, the display information selection program 144 displays information showing that overtaking is safe as an estimation result of the safety of overtaking on the rear display 12 (S5). FIG. 6 shows an example of the operation in S5.

FIG. 8 is an explanatory diagram showing another example of information output by the movable body 1 when it is determined that the following movable body 2 can safely overtake the movable body 1 in the first embodiment of the present invention.

Figure 8A:
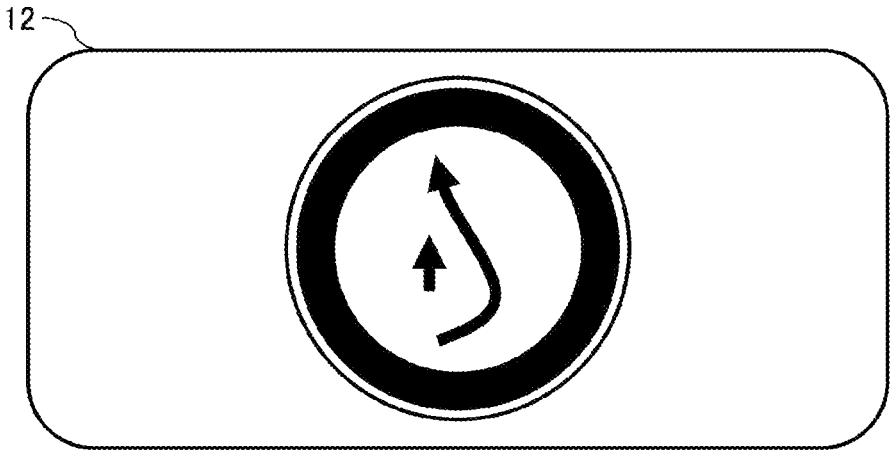
FIGS. 8A and 8B are explanatory diagrams showing another example of information output by the movable body when it is determined that the following movable body can safely overtake the movable body in the first embodiment of the present invention.
Figure 8B:
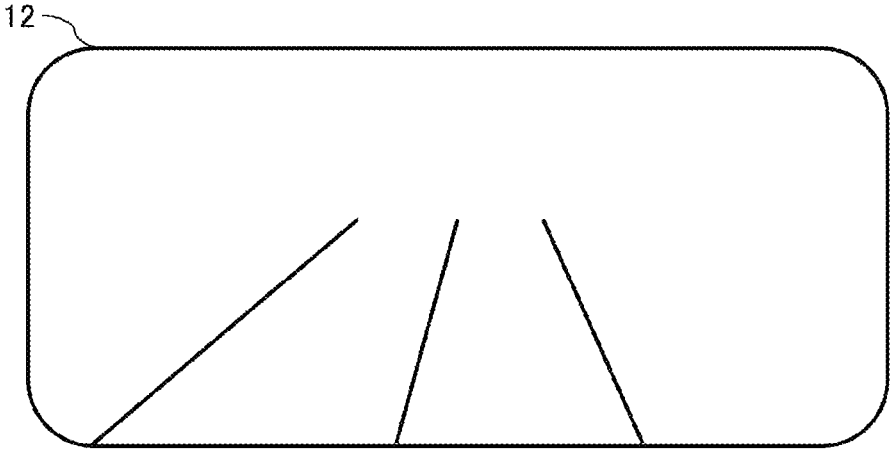

The information displayed by the rear display 12 of the movable body 1 may be, for example, characters such as "overtaking is safe" shown in FIG. 6 or an image of an icon showing "overtaking is safe" as shown in FIG. 8A. Alternatively, when the movable body 1 includes an in-vehicle camera or the like for photographing the front, the rear display 12 may display front video photographed by the in-vehicle camera as shown in FIG. 8B. Alternatively, the rear display 12 may display a combination thereof.

Similarly to the case of S4, in the case where the movable body 1 includes a speaker, audio information may be used to transmit information showing that the overtaking can be safely performed to the following movable body 2.

The processor 13 may control the rear display 12 so that the rear display 12 is easily viewed by the following movable body 1, on the basis of the information acquired from the peripheral object sensor 11. For example, the processor 13 may control the direction of the screen of the rear display 12, as described above. Alternatively, when the peripheral object sensor 11 includes a sensor for detecting the surrounding brightness of the movable body 1, the brightness of the screen of the rear display 12 may be controlled so as to be matched with the surrounding brightness, according to the brightness.

If the driver of the following movable body 2 obtains information showing that overtaking is safe from the movable body 1, the driver can perform overtaking of the movable body 1 by controlling the following movable body 2 (S6).

In the present embodiment, it is assumed that the movable body 1 has the autonomous traveling function. The autonomous traveling function may be a complete autonomous traveling function that does not require any operation by a person or may be an autonomous traveling function that requires a partial operation by the person (or can be operated by the person as necessary).

According to the first embodiment of the present invention described above, the control system of the movable body 1 estimates the safety of overtaking of the movable body 1 by the following movable body 2, on the basis of the information acquired from the peripheral object sensor 11, and outputs a result thereof to the following movable body 2. As a result, dangerous overtaking by the following movable body is prevented.

When it is estimated that overtaking of the movable body 1 by the following movable body 2 cannot be performed safely, the control system may control movement of the movable body 1 so that overtaking becomes difficult. Specifically, the control system may control the movable body 1 so that the movable body 1 travels at a position closer to the opposite lane than the center of the lane. As a result, dangerous overtaking by the following movable body 2 is prevented.

On the other hand, when it is estimated that overtaking of the movable body 1 by the following movable body 2 can be performed safely, the control system may control movement of the movable body 1 so that overtaking becomes easy. Specifically, the control system may control the movable body 1 so that the movable body 1 travels at a position farther from the opposite lane than the center of the lane and decelerates. As a result, the safety of overtaking by the following movable body 2 is increased and dangerous overtaking is prevented.

The control system may display the character or the image showing the estimation result of the safety of overtaking with respect to the following movable body 2 or may output the audio information showing the estimation result of the safety of overtaking with respect to the following movable body 2. As a result, even when the following movable body 2 does not have a function of communicating with other movable bodies, dangerous overtaking can be prevented by providing necessary information to the driver of the following movable body 2.

When the character or the image showing the estimation result of the safety of overtaking is displayed with respect to the following movable body 2, the control system may control the movement of the movable body 1 so that the driver of the following movable body 2 easily views the display and may control the display device to display the character or the image. For example, the control system may control the direction of the screen of the display device so that the driver of the following movable body 2 easily views the display or may control the brightness of the screen of the display device to be matched with the surrounding brightness of the movable body 1. As a result, the driver of the following movable body 2 surely views the display, so that dangerous overtaking is prevented.

Further, the peripheral object sensor 11 may include a camera for photographing the front of the movable body 1 and the display device may output video photographed by the camera. As a result, the driver of the following movable body 2 easily determines the safety of overtaking and dangerous overtaking is prevented.

Second Embodiment

In the first embodiment, it is assumed that a movable body 1 has an autonomous traveling function. However, the scope of application of the present invention also includes the case where the movable body 1 is operated by a driver who gets on the movable body 1. A second embodiment shows a situation where the movable body 1 is operated by the driver who gets on the movable body 1. Since each component of a system according to the second embodiment has the same function as that of each component denoted by the same reference numeral in the first embodiment, except for a difference to be described below, description thereof will be omitted.

Figure 9:
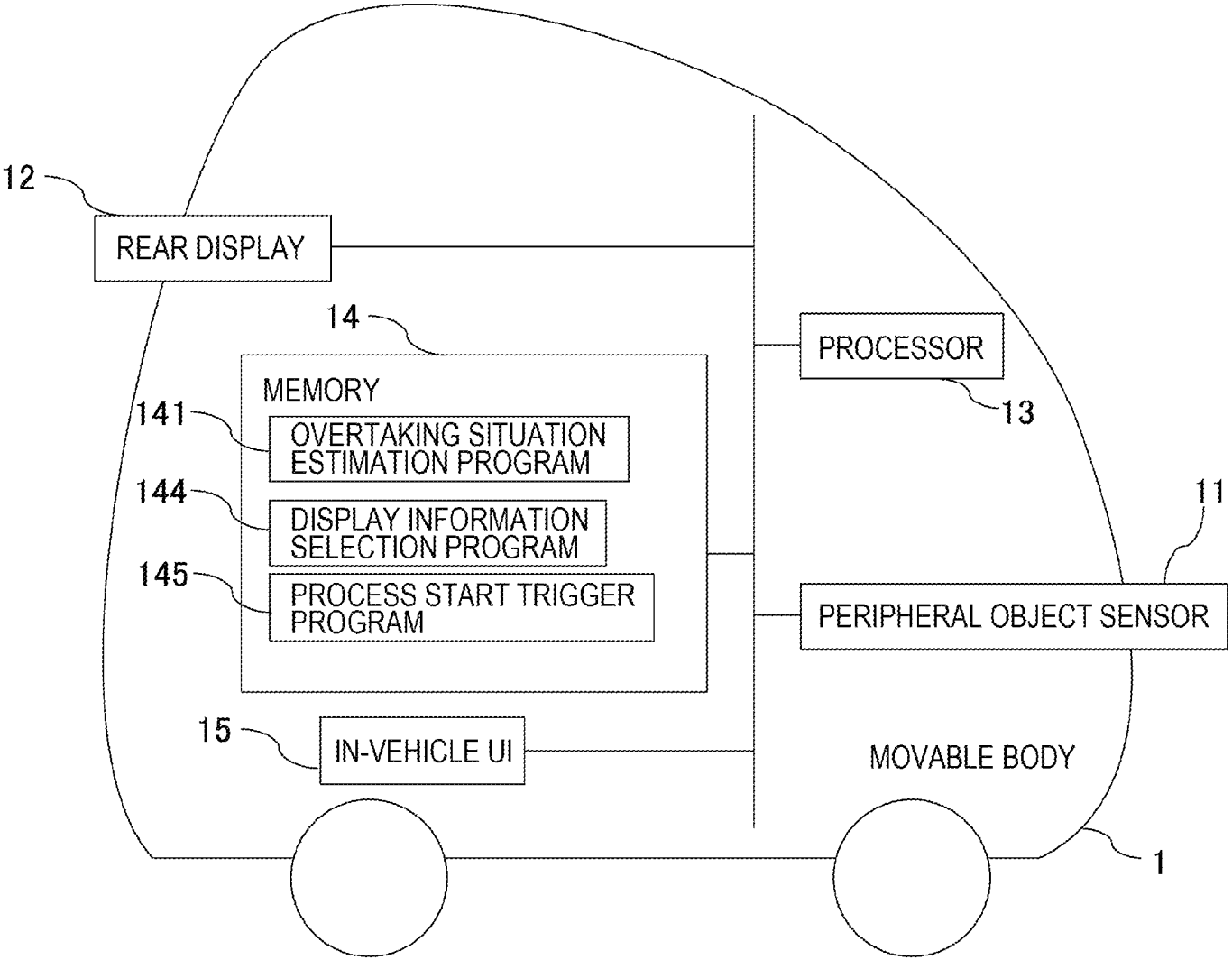
FIG. 9 is a block diagram showing a configuration of a movable body in a second embodiment of the present invention.

FIG. 9 is a block diagram showing a configuration of the movable body 1 in the second embodiment of the present invention.

Differently from the first embodiment, a vehicle position selection program 142 and an operation control program 143 are unnecessary. In addition, an in-vehicle user interface (UI) 15 to transmit information to the driver of the movable body 1 is necessary. The in-vehicle UI 15 includes at least an output device that outputs information to the driver of the movable body 1, for example, a display device that outputs characters or images or a speaker that outputs audio.

Figure 10:
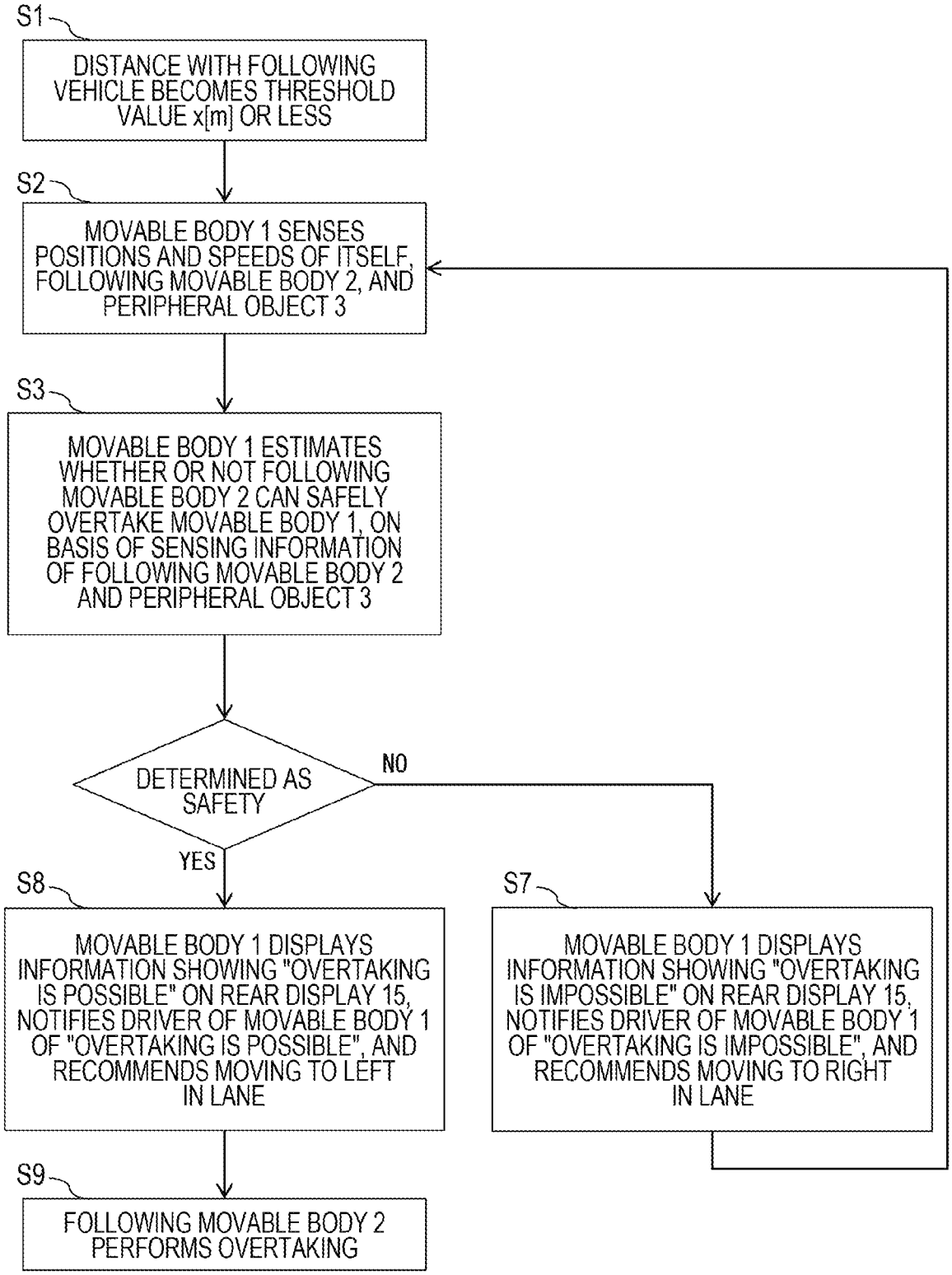
FIG. 10 is a flowchart showing a whole process of the movable body in the second embodiment of the present invention.

FIG. 10 is a flowchart showing a whole process of the movable body 1 in the second embodiment of the present invention. Hereinafter, an operation of the present embodiment will be described according to the present flowchart with a focus on the difference with the first embodiment.

The operation of S1 to S3 is the same as that in the first embodiment. When an overtaking situation estimation program 141 estimates that safe overtaking cannot be performed, a display information selection program 144 displays information showing that safe overtaking cannot be performed on a rear display 12, similarly to S4 of the first embodiment. Further, the display information selection program 144 displays information for explaining the corresponding situation to the driver of the movable body 1 and transmitting a recommendation operation on the in-vehicle UI 15 (S7).

On the other hand, when the overtaking situation estimation program 141 estimates that safe overtaking can be performed, the display information selection program 144 displays information showing that safe overtaking can be performed on the rear display 12, similarly to S5 of the first embodiment. Further, the overtaking situation estimation program 141 displays information for explaining the corresponding situation to the driver of the movable body 1 and transmitting a recommendation operation on the in-vehicle UI 15 (S8).

The driver of the following movable body 2 that has acquired the information displayed on the rear display 12 in S8 can perform overtaking of the movable body 1 by controlling the following movable body 2 (S9).

FIG. 11 is an explanatory diagram showing an example of the information displayed on the in-vehicle UI 15 by the movable body 1 in the second embodiment of the present invention.

Figure 11A:
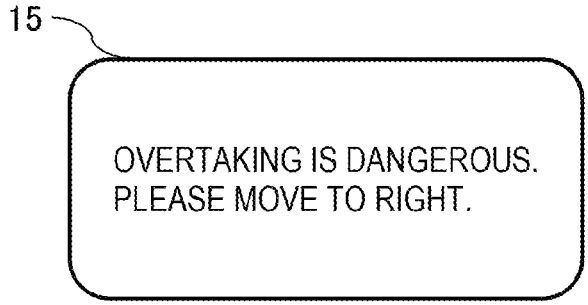
FIGS. 11A and 11B are explanatory diagrams showing an example of information displayed on an in-vehicle UI by the movable body in the second embodiment of the present invention.

Specifically, FIG. 11A shows an example of information (S7) displayed on the in-vehicle UI 15 in a situation where it is estimated that safe overtaking cannot be performed. When the movable body 1 travels on the left side in the lane, it induces overtaking by the following movable body 2. For this reason, the in-vehicle UI 15 outputs information recommending traveling at a rightward position in the lane. In the example of FIG. 11A, character information showing "Overtaking is dangerous. Please move to the right" is displayed. According to this information, the driver of the movable body 1 controls the movable body 1 so that the movable body 1 travels on the right side in the lane, thereby suppressing overtaking of the movable body 1 by the following movable body 2.

Figure 11B:
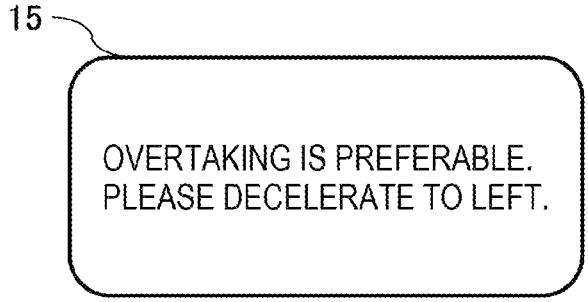

On the other hand, FIG. 11B shows an example of information (S8) displayed on the in-vehicle UI 15 in a situation where it is estimated that safe overtaking can be performed. The in-vehicle UI 15 outputs information recommending traveling at a leftward position in the lane and further deceleration. In the example of FIG. 11B, character information showing "Overtaking is preferable. Please decelerate to the left" is displayed. According to this information, the driver of the movable body 1 controls the movable body 1 so that the movable body 1 travels on the left side in the lane and decelerates, thereby inducing overtaking of the movable body 1 by the following movable body 2.

In the above examples, the in-vehicle UI 15 displays the character information. However, this is only an example and the in-vehicle UI may output information other than the character. For example, the in-vehicle UI may display an image showing the recommended control content of the movable body 1 as described above or may output audio for reading the character information.

According to the second embodiment of the present invention described above, when it is estimated that overtaking of the movable body 1 by the following movable body 2 cannot be safely performed, the control system of the movable body 1 outputs information recommending traveling at a position closer to the opposite lane than the center of the lane to the driver of the movable body 1. On the other hand, when it is estimated that overtaking the movable body 1 by the following movable body can be safely performed, the control system of the movable body 1 outputs information recommending traveling at a position farther from the opposite lane than the center of the lane and deceleration to the driver of the movable body 1. The driver of the movable body 1 performs an operation according to this information, so that dangerous overtaking by the following movable body 2 is prevented.

The present invention is not limited to the embodiments described above and various modifications are included. For example, the embodiments are described in detail to facilitate the understanding of the present invention and the present invention is not limited to including all of the configurations described above. In addition, a part of the configurations of the certain embodiment can be replaced by the configurations of another embodiment or the configurations of another embodiment can be added to the configurations of the certain embodiment. In addition, a part of the configurations of the individual embodiments may be removed or may be added or replaced with other configurations.

In addition, a part or all of the individual configurations, functions, processing units, and processing mechanisms may be designed by integrated circuits and may be realized by hardware. In addition, the individual configurations and functions may be realized by software by analyzing programs for realizing the functions by a processor and executing the programs by the processor. Information such as programs, tables, and files for realizing the individual functions can be stored in a storage device such as a nonvolatile semiconductor memory, a hard disk drive, and a solid state drive (SSD) and a computer readable non-transitory data storage medium such as an IC card, an SD card, and a DVD.

In addition, only control lines or information lines necessary for explanation are shown and the control lines or information lines do not mean all control lines or information lines necessary for a product. In actuality, almost all configurations may be mutually connected.

What is claimed is:

1. A control system mounted on a first movable body, comprising:

a sensor recognizing a peripheral object of the first movable body;

a processor connected to the sensor; and a first output device connected to the processor, wherein the processor estimates safety of overtaking of the first movable body by a second movable body moving at the back of the first movable body, on the basis of information acquired from the sensor, and the processor outputs an estimation result of the safety to the second movable body via the first output device, wherein when it is estimated that overtaking of the first movable body by the second movable body is not safely performed, the processor controls the movement of the first movable body so that overtaking of the first movable body by the second movable body becomes difficult.

2. The control system according to claim 1, wherein the first movable body and the second movable body are vehicles traveling on a road, and when it is estimated that overtaking of the first movable body by the second movable body is not safely performed, the processor controls the movement of the first movable body so that the first movable body travels at a position closer to an opposite lane than a center of a lane.

3. The control system according to claim 1, further comprising: a second output device connected to the processor, wherein the first movable body and the second movable body are vehicles traveling on a road, and when it is estimated that overtaking of the first movable body by the second movable body is not safely performed, the processor outputs information recommending that the first movable body travels at a position closer to an opposite lane than a center of a lane to a driver of the first movable body, via the second output device.

4. The control system according to claim 1, wherein when it is estimated that overtaking of the first movable body by the second movable body is safely performed, the processor controls the movement of the first movable body so that overtaking of the first movable body by the second movable body becomes easy.

5. The control system according to claim 1, wherein the first movable body and the second movable body are vehicles traveling on a road, and when it is estimated that overtaking of the first movable body by the second movable body is safely performed, the processor controls the movement of the first movable body so that the first movable body travels at a position farther from an opposite lane than a center of a lane and decelerates.

6. The control system according to claim 1, further comprising: a second output device connected to the processor, wherein the first movable body and the second movable body are vehicles traveling on a road, and when it is estimated that overtaking of the first movable body by the second movable body is safely performed, the processor outputs information recommending that the first movable body travels at a position farther from an opposite lane than a center of a lane and decelerates to a driver of the first movable body, via the second output device.

7. A control system mounted on a first movable body, comprising:

a sensor recognizing a peripheral object of the first movable body;

a processor connected to the sensor; and a first output device connected to the processor, wherein the processor estimates safety of overtaking of the first movable body by a second movable body moving at the back of the first movable body, on the basis of information acquired from the sensor, the processor outputs an estimation result of the safety to the second movable body via the first output device, the first output device is a display device displaying a character or an image showing the estimation result of the safety, wherein the processor specifies a position relation between the first movable body and the second movable body, on the basis of the information acquired from the sensor, and the processor controls the movement of the first movable body so that the position relation between the first movable body and the second movable body becomes a position relation where the display device is easily viewed by a driver of the second movable body, on the basis of the specified position relation.

8. The control system according to claim 7, wherein the processor controls the display device so that the display device is easily viewed by a driver of the second movable body, on the basis of the information acquired from the sensor, the display device has a drive device adjusting a direction of a screen of the display device, the processor specifies a position relation between the first movable body and the second movable body, on the basis of the information acquired from the sensor, and the processor controls the drive device so that the screen of the display device is oriented in a direction where the screen is easily viewed by the driver of the second movable body, on the basis of the specified position relation.

9. The control system according to claim 8, wherein the sensor includes a sensor detecting a surrounding brightness of the first movable body and the processor controls the display device so that a brightness of the screen of the display device is matched with the surrounding brightness of the first movable body, on the basis of the information acquired from the sensor.

10. The control system according to claim 7, wherein the first output device is an audio output device outputting audio showing the estimation result of the safety.

* * * * *